US007073792B2

(12) United States Patent
Esposito

(10) Patent No.: US 7,073,792 B2
(45) Date of Patent: Jul. 11, 2006

(54) METHOD OF PLAYING A GAME THAT PROMOTES INTERACTIVE COMMUNICATION AND SCORING BETWEEN PLAYERS

(76) Inventor: David A. Esposito, 963 Bucks Rd., Perkasie, PA (US) 18944

( * ) Notice: Subject to any disclaimer, the term of this patent is extended or adjusted under 35 U.S.C. 154(b) by 0 days.

(21) Appl. No.: 10/672,590

(22) Filed: Sep. 26, 2003

(65) Prior Publication Data

US 2005/0067781 A1 Mar. 31, 2005

(51) Int. Cl.
*A63F 3/00* (2006.01)

(52) U.S. Cl. ..... 273/243; 273/430

(58) Field of Classification Search ..... 273/236, 273/242, 243, 248, 249, 430, 431, 432, 429
See application file for complete search history.

(56) References Cited

U.S. PATENT DOCUMENTS

| | | | | |
|---|---|---|---|---|
| 1,559,954 | A | 11/1925 | Gifford | |
| 3,951,411 | A | 4/1976 | Hill et al. | |
| 4,016,939 | A | 4/1977 | Thron | |
| 4,040,628 | A | 8/1977 | Pope | |
| 4,273,337 | A * | 6/1981 | Carrera et al. | 273/243 |
| 4,323,249 | A | 4/1982 | Brady | |
| 4,449,710 | A | 5/1984 | Davis | |
| 4,682,777 | A | 7/1987 | Wood | |
| 4,795,160 | A | 1/1989 | Sterling | |
| 4,889,344 | A | 12/1989 | Zimba | |
| 4,917,387 | A | 4/1990 | Roggero | |
| 4,962,934 | A | 10/1990 | Taylor | |
| 5,071,134 | A | 12/1991 | Burroughs, Jr. | |
| 5,104,127 | A | 4/1992 | Whitney | |
| 5,118,113 | A * | 6/1992 | Ahlers et al. | 273/243 |
| 5,120,066 | A | 6/1992 | Cohen | |
| 5,269,530 | A | 12/1993 | Miller | |
| 5,273,431 | A | 12/1993 | Charouhas | |
| 5,295,834 | A * | 3/1994 | Saunders | 434/128 |
| 5,362,061 | A | 11/1994 | Napolitano | |
| 5,362,062 | A | 11/1994 | Schott | |
| 5,375,846 | A * | 12/1994 | Smith | 273/292 |
| 5,445,389 | A | 8/1995 | Jeffreyes, Jr. | |
| 5,451,061 | A | 9/1995 | DeLessio et al. | |
| 5,480,157 | A | 1/1996 | Plummer | |
| 5,584,484 | A | 12/1996 | Kenvyn | |
| 5,882,008 | A * | 3/1999 | Siegesmund | 273/249 |
| 5,899,456 | A | 5/1999 | Weinstock et al. | |
| 5,931,469 | A | 8/1999 | Stichnoth | |
| 6,019,370 | A * | 2/2000 | Morris | 273/249 |
| 6,120,028 | A | 9/2000 | Boyer | |

(Continued)

FOREIGN PATENT DOCUMENTS

| | | |
|---|---|---|
| GB | 2206286 | 1/1989 |

(Continued)

*Primary Examiner*—Vishu K. Mendiratta
(74) *Attorney, Agent, or Firm*—Frank A. Mazzeo, P.C.; Frank A. Mazzeo

(57) ABSTRACT

A method of playing a game that requires a plurality of players to interactively communicate. The method includes: providing a player-in-turn with a hypothetical situation; the player-in-turn presents an analysis of what should be done in the hypothetical situation and provides reasoning supporting the analysis to at least one player-out-of-turn; each of the at least one player-out-of-turn evaluates the analysis and the reasoning of the player-in-turn and assigns a score to the player-in-turn based on the evaluation; and using the score to generate a ranking of the player-in-turn at the end of the game.

11 Claims, 6 Drawing Sheets

U.S. PATENT DOCUMENTS

| | | | | |
|---|---|---|---|---|
| 6,120,296 | A | 9/2000 | Lim | |
| 6,139,016 | A | 10/2000 | Plato | |
| 6,224,057 | B1 * | 5/2001 | Morton | 273/272 |
| 6,267,375 | B1 | 7/2001 | Bernstein et al. | |

FOREIGN PATENT DOCUMENTS

| | | |
|---|---|---|
| GB | 2215222 | 9/1989 |
| GB | 2203957 | 11/1998 |

* cited by examiner

38

62

SCORESHEET

| EVENT # | POSITION POINTS | SCENARIO # | RATING POINT AVERAGE | NOTES |
|---|---|---|---|---|
| 1 | 60 | | | |
| 2 | | | 62 | |
| 3 | | | | |
| 4 | | 54 | | |
| 5 | | | | |
| 6 | | | | 64 |
| 7 | | | | |
| 8 | | | | |
| 9 | 65 | | | |
| 10 | | | | |
| 11 | | | | |
| 12 | | | | |
| 13 | | | | |
| 14 | | | | |
| 15 | | 54 | | |
| 16 | | | | |
| 17 | | | | |
| 18 | | | | |
| 19 | | | 62 | |
| 20 | | | | 64 |
| 21 | | | | |
| 22 | | | | |
| 23 | | | | |
| 24 | | | | |
| 25 | | | | |
| TOTAL: | | | | |

58

BONUS POINTS: 66

TOTAL POINT SCORE: 68 (position points + rating points + bonus points)

*Fig. 11*

METHOD OF PLAYING A GAME THAT PROMOTES INTERACTIVE COMMUNICATION AND SCORING BETWEEN PLAYERS

BACKGROUND

The present invention is directed to games having educational benefits and, more specifically, is directed to a game and method for promoting interactive communication and scoring between players.

Many board games are currently available that are both complex and interesting. In some cases, a board game may also teach a lesson which is implicit in the structure of the game. Many games have been developed that reward or penalize a player based on a player's progress along and location on a game board. Unfortunately, such games do not allow players to truly contemplate difficult choices and the values which are implicated by those choices due to the relatively rigid feedback, if any, provided by conventional board games, usually in the form of a predetermined award or penalty based on a player's progress along the game board.

It would be advantageous to provide a game and method that preferably encourages interactive communication between players and that allows players to score each other while discussing various hypothetical situations.

SUMMARY

One embodiment of the present invention is directed to a method of playing a game that encourages a plurality of players to interactively communicate. The method includes: providing a player-in-turn with a hypothetical situation; the player-in-turn presents an analysis of what should be done in the hypothetical situation and provides reasoning supporting the analysis to at least one player-out-of-turn; each of the at least one player-out-of-turn evaluates the analysis and the reasoning of the player-in-turn and assigns a score to the player-in-turn based on the evaluation; and using the scores to generate a ranking of the player-in-turn at the end of the game.

BRIEF DESCRIPTION OF THE DRAWINGS

The foregoing summary, as well as the following detailed description of the preferred embodiment of the present invention, will be better understood when read in conjunction with the appended drawings. For the purpose of illustrating the invention, there is shown in the drawings, an embodiment which is presently preferred. It is understood, however, that the present invention is not limited to the precise arrangement and instrumentality shown. In the drawings:

FIG. 11 is a top plan view of a preferred score sheet for use by a player designated to tally points for each player;

DETAILED DESCRIPTION OF THE PREFERRED EMBODIMENTS

Figure 1:
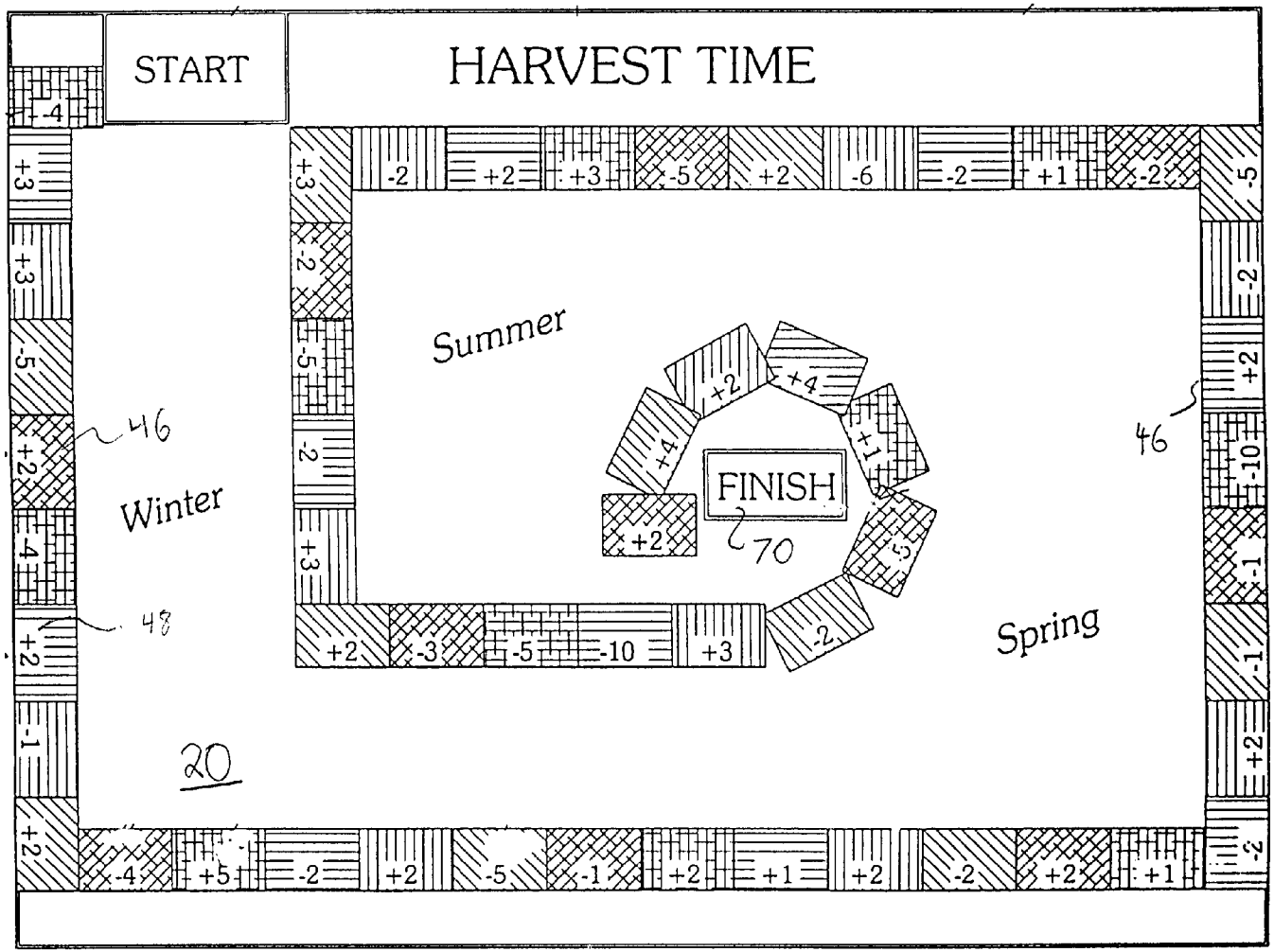
FIG. 1 is a plan view of a preferred game board according to the present invention which is suitable for use with the preferred method of the present invention.
Figure 2:
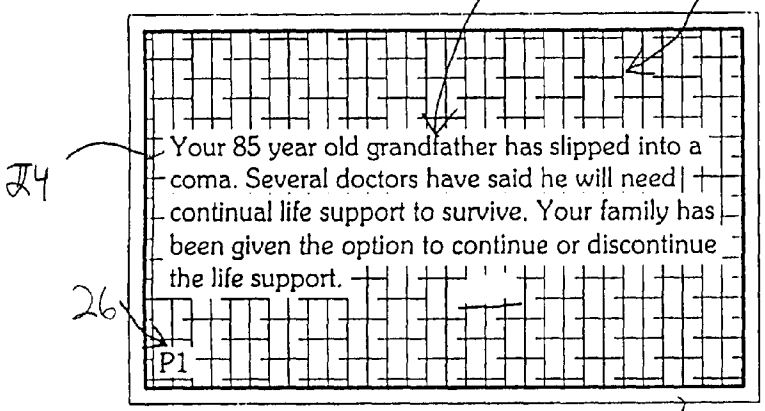
FIG. 2 is a bottom plan view of a card according to the present invention from a deck that is preferably used to organize a prearranged group of hypothetical situations; the bottom side of the card includes text representing a hypothetical situation and a unique identifier in a lower left corner thereof.
Figure 3:
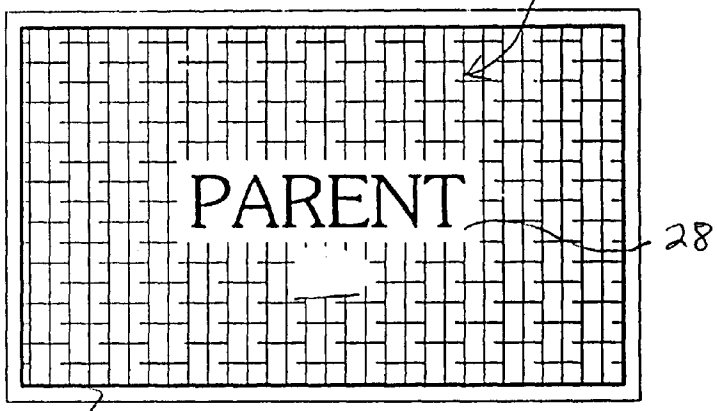
FIG. 3 is a preferred top plan view of the card of FIG. 2 and preferably includes text representing the prearranged group to which the corresponding hypothetical situation on the bottom side of the card applies.
Figure 4:
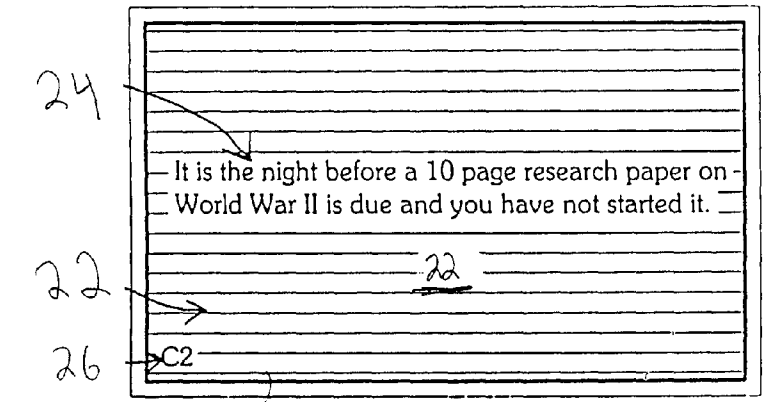
FIG. 4 is a bottom plan view of a card according to the present invention that includes text representing a hypothetical situation likely to be encountered by a child.
Figure 5:
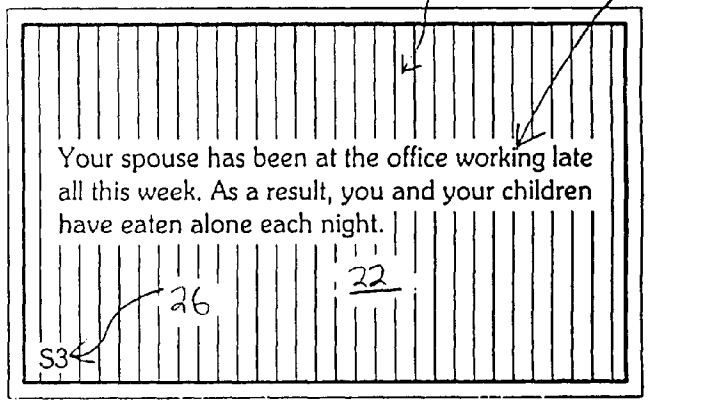
FIG. 5 is bottom plan view of a card according to the present invention that includes text representing a hypothetical situation commonly encountered by a spouse.
Figure 7:
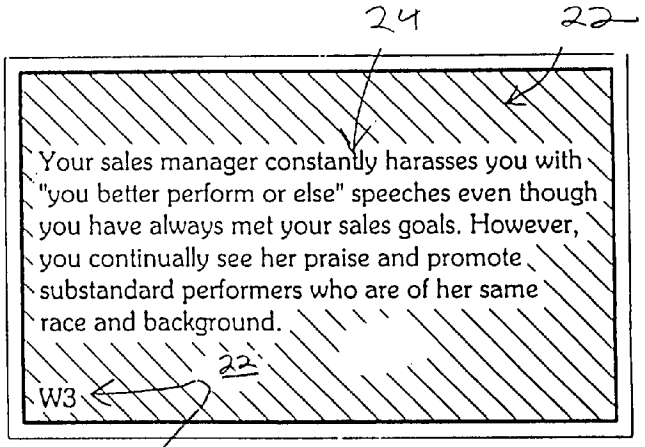
FIG. 7 is a bottom plan of view of card according to the present invention that includes text representing a hypothetical situation commonly encountered in the work place.
Figure 6:
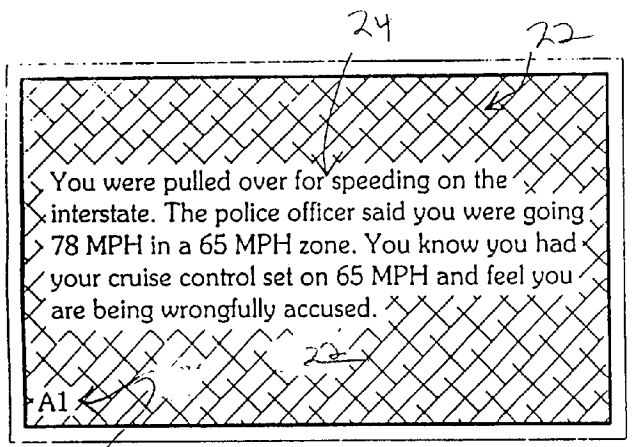
FIG. 6 is a bottom plan view of a card that includes text representing a hypothetical situation commonly encountered by adults.
Figure 9:
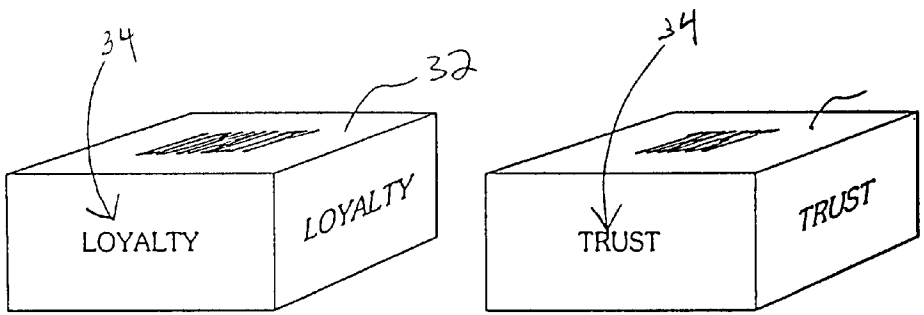
FIG. 9 is a perspective view of two preferred game pieces for use by players to identify a player's position on the game board of FIG. 1; it is preferred that each game piece identify a different value, or principle, which may be used by a player to evaluate a hypothetical situation.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the game board and designated parts thereof. The words "player-in-turn," as used in the claims and in the corresponding portions of the specification, mean "the player whose turn it is to move his or her game piece and to make a presentation in response to a hypothetical situation." The words "player-out-of-turn," as used in the claims and in the corresponding portions of the specification, means "a player who is currently not moving his or her game piece and is not responsible to make a presentation based on hypothetical situation." Additionally, the words "a" and "one" are defined as including one or more of the referenced item unless specifically stated otherwise. The terminology of this application includes the words above specifically mentioned, derivatives thereof, and words of similar import.

Referring to FIGS. 1–14, wherein like numerals indicate like elements throughout, a preferred embodiment of game for use with the preferred method of the present invention is shown. Briefly stated, the method of the present invention allows players the opportunity to be intellectually challenged in a cooperative, non-threatening environment in order to develop decision making capabilities based on principles that will foster the development of strong, productive relationships and enable individuals to reach greater levels of accomplishment. The development of improved decision-making capability that is made possible by the method of the present invention results from the players preferably interactively communicating with each other and scoring each other throughout the game.

Referring to FIG. 1, a preferred game board 20 preferably depicts the four seasons of a farming cycle as part of the games preferred emphasis that in order to reap an abundant harvest in any aspect of life, one must first: plan and prepare (commonly done during winter); plow the ground and plant seeds (commonly done during spring); water and cultivate the seeds (commonly done during summer); and collect the harvest (commonly done in the fall which is also referred to as harvest time).

Figure 8:
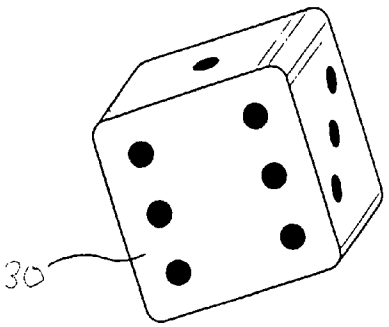
FIG. 8 is a perspective view of a die which is the preferred method of randomly determining the number of spaces that a player's game piece should advance when the player taking his or her turn as the player-in-turn.

The method of the present invention preferably allows each of the players to take turns as a player-in-turn and, at other times, as one of the at least one player-out-of-turn. The method also preferably includes randomly determining a number of spaces 46 to advance a game piece 32 of one of the plurality of players who is currently the player-in-turn on the game board 20. Referring to FIG. 8, the preferred method of randomly determining the number of spaces 46 to advance a game piece 32 is to roll at least one die 30. However, any method of randomly determining numbers can be used without departing from scope of the present invention. Then, the game piece 32 may be advanced by the number of spaces to a specific space 46 on the board 20. The spaces 46 preferably form a path that winds generally inwardly in a spiral fashion on the board 20.

Each space 46 preferably includes score modifiers 48 that add or subtract points from the accumulated points of the player-in-turn based on a scenario described on the specific space onto which the game piece 32 is moved. For example, a space 46 may display a score modifier of "+4" and include text stating "Train for and successfully complete a marathon." Alternatively, a space 46 may display a score modifier of "−6" and state "Drop out of high school prior to graduation." It is preferred that each of the spaces 46 describe a real world situation and associate a positive or negative judgment of the situation using the score modifier 48.

The method of the present invention includes providing a player-in-turn with a hypothetical situation such as those depicted by the text 24 in FIGS. 2 and 4–7. Each of the hypothetical situations preferably challenges the player-in-turn to evaluate a difficult situation based on a principled analysis. For example, the hypothetical situation presented on a card could be "the supervisor you work for is clearly a well intentioned person who is generally very agreeable to work with. However, for last few days he has provided overly detailed instructions which you feel are insulting and may reflect a low opinion of your intellect." The player-in-turn would then have to determine how such a situation should be handled.

It is preferred that the hypothetical situations are provided in prearranged groups (e.g, in multiple decks of cards) from which an individual hypothetical situation may be provided to the player-in-turn. The preferred embodiment includes multiple decks of hypothetical situations that are organized into multiple groups. Each group corresponds to a separate type of hypothetical situation. Some groups that the hypothetical situations can be arranged into are those situations that: may be encountered by parents, by children, by spouses, by adults and by participant's in the workplace.

It is also preferred that at least some of the plurality of designated spaces 46 on the game board 20 correspond to one of the prearranged groups of hypothetical situations (i.e., preferably corresponds to one of the multiple groups of hypothetical situations). For example, the decks that each represent prearranged hypothetical situations can each color coded to correspond to specific spaces 46 on the board 20.

It is preferred that each of the decks of cards contain hypothetical situations that only pertain to its group's respective subject matter. It is preferred that each card include a unique identifier 26 to allow players to later review their scores and the specific hypothetical situations in which the scores were given. It is preferred that each deck of cards be identified by a separate color which corresponds to colors of the spaces 46 on the game board 20. Accordingly, once the player-in-turn moves their game piece 32 by a randomly determined number of spaces to a specific space 46 on the board, it is preferred that the hypothetical situation with which the player-in-turn is presented is selected from one of the multiple groups of hypothetical situations that corresponds to the specific color of the space 46 on the game board 20 to which the player-in-turn's game piece 32 is advanced.

Figure 10:
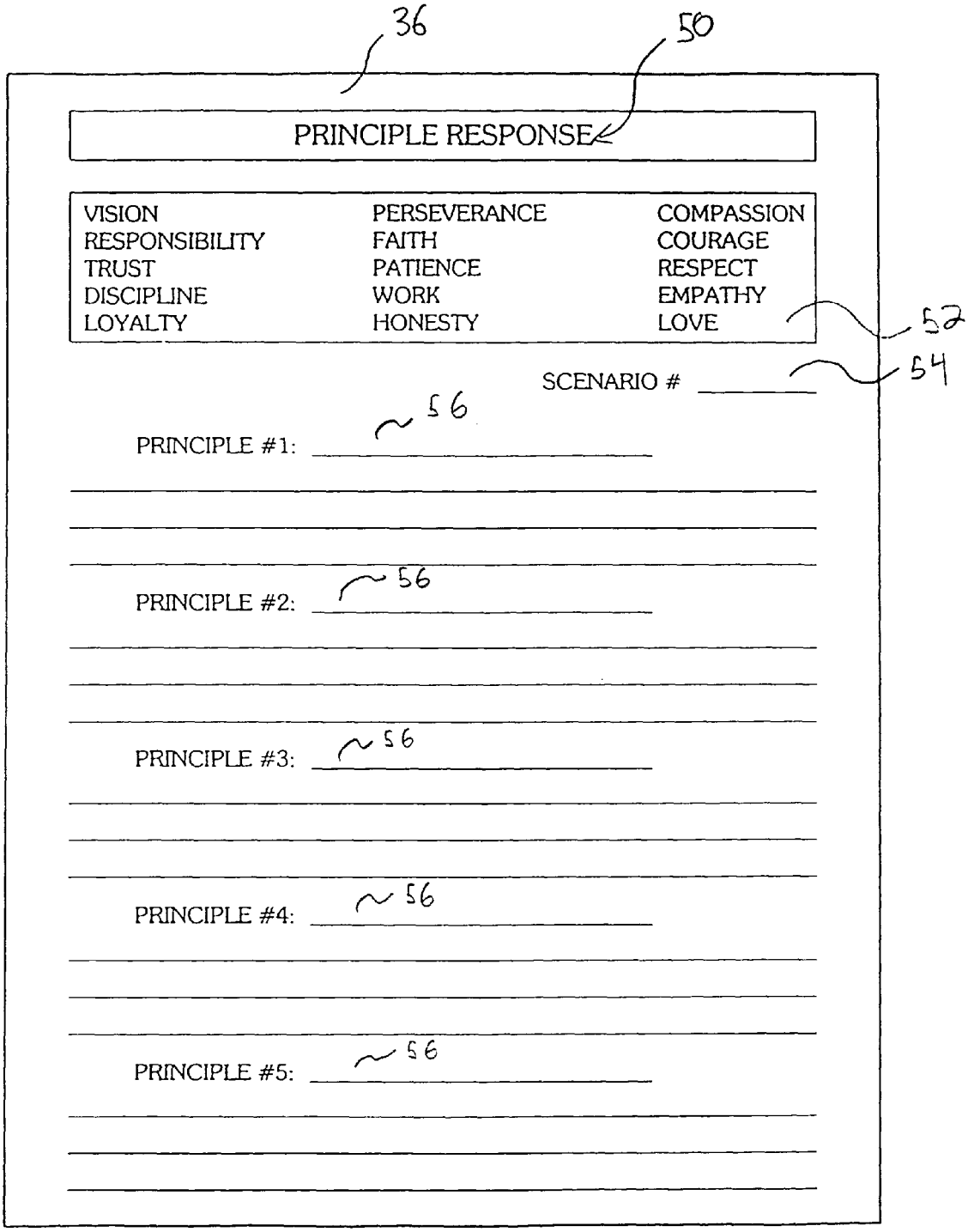
FIG. 10 is a top plan view of a preferred form that can be used by a player-in-turn to organize his or her thoughts prior to making a presentation to the remaining players.
Figure 12:
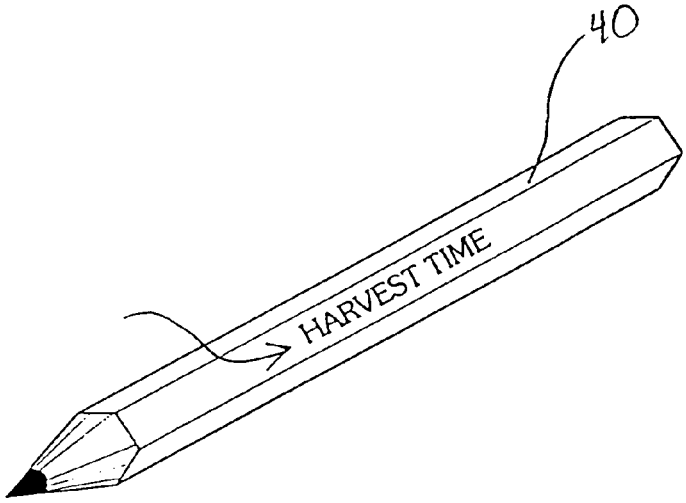
FIG. 12 is a perspective view of a pencil 40 which can be included as part of a kit to be used with the method of present invention.

Referring to FIG. 10, it is preferred that the player-in-turn has the opportunity to write notes corresponding to reasons that will be used to support the player-in-turn's presentation of what should be done in a particular hypothetical situation. A form 36 for recording notes preferably includes a title field 50, a value list field 52, a scenario identifier field 54, and principle notation fields 56. The preferred values contained in the value list field 52 are: vision; responsibility; trust; discipline; loyalty; perseverance; faith; patience; work; honesty; compassion; courage; respect; empathy; and love. The preferred form 36 is used as follows. Once a player-in-turn has read the text 24 describing the hypothetical situation of interest, the player-in-turn records the unique situation identifier 26 for the hypothetical in the scenario identifier field 54 of the form 36. Then, the player-in-turn determines how the hypothetical situation should be handled and makes notes as to which principles justify his or her position. It is preferred that a separate principle is listed in each of the principle notation fields 56 along with details as to how that particular principle supports the player-in-turn's upcoming presentation. In another embodiment, the player-in-turn does not make notes.

Figure 13:
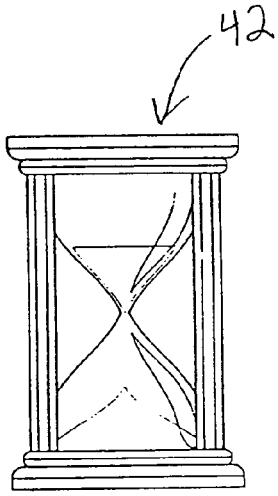
FIG. 13 is a side elevational view of an hour glass which can be included as part of a kit for use with the method of the present invention.
Figure 14:
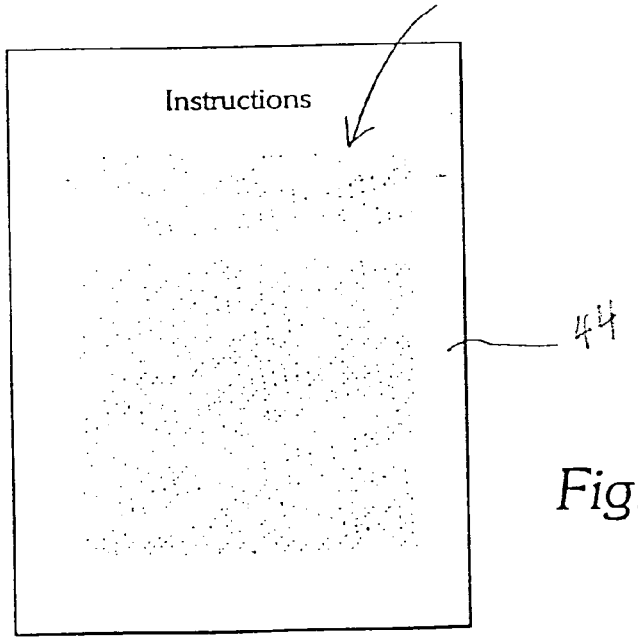
FIG. 14 is a top plan view of an instruction sheet that can be included as part of a kit for use with the method of the present invention.

Then, the player-in-turn presents an analysis of what should be done in the hypothetical situation and provides reasoning supporting the analysis to at least one player-out-of-turn. It is preferred that the reasoning include at least one of a plurality of principles listed on a master list or in the value list field 52 of the form 36. It is also preferred that the player-in-turn have only a limited time to present his or her analysis and supporting reasoning. Referring to FIG. 13, an hour glass 42 may be used to regulate the time allotted to the player-in-turn.

Then, each of the at least one players-out-of turn evaluates the analysis and reasoning of the player-in-turn and assigns a score to the player-in-turn based on the evaluation. It is preferred, but not necessary, that the score range on scale of zero (0) to ten (10) with the higher scores representing stronger agreement. It is preferred that a separate score sheet 38 be used for each player to determine the total point score of the corresponding player at the end of the game. While it is preferred each of the players-out-of-turn score the player-in-turn's presentation, the player-in-turn can be scored by a single player-out-of-turn without departing from the scope of the present invention.

Referring to FIG. 11, the preferred score sheet includes an event number field 58, a position points field 60, a scenario identifier field 54, an average score field 62, a notation field 64, a bonus points field 66, and a total score field 68. It is preferred that each player-in-turn is assigned position points depending upon the score modifier 48 located on each space 46 onto which a player-in-turn's game piece 32 is positioned. Each time a player takes a turn as the player-in-turn, a separate event row is preferably filled in with the appropriate score after the score modifier 48 is recorded in the position point field 60 and the hypothetical identifier 26 is recorded in the scenario identifier field 54. Once each of the players-out-of-turn generates a score for the presentation of the player-in-turn, the scores are preferably averaged and the resulting average score is recorded in the average score field 62. While one preferred method of scoring a player-in-turn has been disclosed above, those of ordinary skill in the art will appreciate from this disclosure that any suitable method of scoring the player-in-turn by the players-out-of-turn can be used without departing from the scope of the present invention.

It is preferred that the at least one player-out-of-turn provides feedback on the player-in-turn's presentation and/or provides advice to the player-in-turn. This interactive communication supplements the feedback and communication which is generated by the scoring of the player-in-turn by the players-out-of-turn and provides an opportunity for all of the players to confront a real world situation without fear of consequences by challenging all of the players to develop principle based reasons for their actions. The interactive communication encountered at this point in the game will allow an opportunity for individuals to learn from each other and ultimately improve one's ability to handle difficult situations when encountered in the "real world." It is preferred that the at least one player-out-of-turn has only a limited time to present any critique and/or advice.

The method of the present invention includes using the player's scores to generate a ranking of the player-in-turn at the end of the game. It is preferred that each of the plurality of players that has not reached a designated game over space 70 on the board is allowed to take a turn as the player-in-turn until each of the players has a game piece 32 that has reached the designated game over space 70. Alternatively, players may be allowed to continue to make presentations regarding hypothetical situations even after they have reached the game over space 70 without departing from the scope of the present invention.

It is preferred that bonus points or extra points be awarded to the player-in-turn for reaching the designated game over space 70 depending on how many of the players have reached the designated game over space 70 in advance of the player-in-turn. For example, the first player-in-turn to reach the game over space 70 may be awarded twenty (20) points, while the second player-in-turn to reach the game over space 70 may be awarded fifteen (15) points, and the third player-in-turn to reach game over space 70 may be awarded ten (10) bonus points. It is preferred that once all of the players have reached the game over space 70, the total score of each of the players is compared to determine a winner.

While one preferred embodiment of the game and method of the present invention have been described in connection with a board game 20, those of ordinary skill in the art will appreciate from this disclosure that this method may be adapted for use with a computer or other electronic device without departing from the scope of the present invention. Additionally, while particular forms, shapes, and principles have been detailed above, those of ordinary skill in the art will appreciate that such particulars may be altered or varied without departing from the scope of the present invention.

Referring to FIGS. 1–14, one embodiment of the present invention operates as follows. Each player chooses a game piece 32 which preferably has a separate principle identified thereon. Then, forms 36 are distributed to players for use in preparing notes for presentations. It is preferred that one player be designated as being a judge. The judge is in charge of using a timer, such as the hour glass 42, to limit the time of presentations and critiques is also responsible for maintaining order during discussions. Of course, the role of judge can be rotated throughout the game. A random method is then used to determine the order in which the players will serve as the player-in-turn.

As each player becomes the player-in-turn, that player randomly determines the number of spaces his or her game piece 32 will advance on the game board 20. When the player-in-turn's game piece 32 is advanced on the board 20 a specific number spaces 46, the appropriate score modifier 48 will be recorded on the player's score sheet 38. Depending on the coding of the space 46 (which is preferably accomplished by color coding the spaces 46), a hypothetical situation will be selected from the corresponding one of multiple groups of prearranged hypothetical situations. It is preferable that the player-in-turn reads this situation aloud and that the judge records the identifier 26 in the scenario identifier field 54 of the score sheet 38. It is preferred that the player-in-turn then makes notes on a form 36 that will be used to make a presentation to the at least one player-out-of-turn.

After the player-in-turn has presented his or her opinion as to what should be done in the hypothetical situation and provided any supporting reasons, the players-out-of-turn preferably have an opportunity to provide feedback on the player-in-turn's analysis and to provide any advice. Once this discussion section has concluded, each of the players-out-of-turn scores the player-in-turn's response to the hypothetical situation using a predetermined point scale. It is preferred that the judge average all of the scores provided by the players-out-of-turn and record the average in the average score field 62 on the score sheet 38.

Then one of the players-out-of-turn becomes the player-in-turn and the prior player-in-turn becomes a player-out-of-turn and the game continues. The game is preferably completed when each of the players reach the game over space 70. It is preferred that when using a die 30 to advance game pieces 32, that a player will automatically move their game piece 32 to the game over space 70 if the die 30 indicates a number of spaces should be advanced greater than those remaining between the space 46 supporting the player-in-turn's game piece and the game over space 70. It is preferred, but not necessary, that once a player reaches the game over space 70, that they no longer roll the die 30 or receive hypothetical situations to present. However, they still can participate by continuing to provide feedback and a score as outlined above for the other participants still active on the game board. It is also preferred that bonus points be award to the first, second, and third players to reach the game over space 70 over first.

The game and method of the present invention provides a safe, non-threatening environment for players to develop decision making capabilities and encourages individuals to act in accordance with principles that are vital to success within the family and society. It is the intent of the method of the present invention to reinforce the value of a striving to develop a fulfilling life and to encourage lasting success in relationships, business, and personal growth.

While various steps, board game components, shapes, random number generators, principles, and hypothetical situations have been described above in various embodiments of the present invention, those of ordinary skill in the art will appreciate from this disclosure that any combination of the above features can be used without departing from the scope of the present invention. For example, every aspect of the game, except for the interactive scoring between players, can be automated using an electronic device or the like without departing from the present invention. It is also recognized by those of skill in the art, that changes may be made to the above described embodiments of the invention without departing from the broad inventive concept thereof. It is understood, therefore, that this invention is not limited to the particular embodiments disclosed, but is intended to cover all of the modifications which are within the spirit and scope of the invention as defined by the appended claims and/or shown in the attached drawings.

The invention claimed is:

1. A method of playing a game that requires players to analyze real life situations, the method comprising:

gathering a plurality of players;

selecting an order for the plurality of players to be a player-in turn; and taking turns being a player-in-turn;

wherein for each turn the player in-turn traverses a path formed on a game board as they play the game, wherein the path on the game board has a start and finish point, wherein the path has a plurality of categories defined thereon;

the player in-turn is provided with a hypothetical real-life scenario based on the category associated with their position on the path, wherein the scenario does not have a definitive answer but is used to provoke one's thoughts and principles;

the player in turn analyzes the scenario and provides a response that describes what they believe should be done in response to the scenario, wherein the player-in-turn provides at least one principle, from a list of pre-determined principles, that assisted in their response; and at least one of the other players scores the response;

wherein the list of predetermined principles is written before the game is commenced.

2. The method of claim 1, wherein the at least one of the other players provides feedback to the player in-turn regarding their response.

3. The method of claim 1, wherein the scenario categories include situations that may be encountered by at least some subset of parents, children, spouses, adults, and participants in the workplace.

4. The method of claim 1, further comprising displaying the game board on a computer screen and playing the game with a computer.

5. The method of claim 1, further comprising utilizing a plurality of game pieces for each player to mark their location on the path.

6. The method of claim 1, further comprising randomly determining how far along the path a player moves.

7. The method of claim 1, further comprising tracking amount of time for the response, wherein the time for the response is limited.

8. The method of claim 1, further comprising awarding or subtracting points based on a scenario described on spaces on the path.

9. A method of playing a game that encourages a plurality of players to interactively communicate, the method comprising:

providing a path formed on a game board with a plurality of designated spaces thereon, wherein a plurality of players traverse the path;

providing a plurality of hypothetical situations, wherein the situations are divided into groups, wherein at least some subset of the designated spaces correspond to the situation groups, and wherein the situations do not have specific correct answers, but are used to provoke one's thoughts and principles;

taking turns being player-in-turn, wherein the player-in-turn is provided with a hypothetical situation and provides a response that describes what they believe should be done in response to the scenario, wherein the player-in-turn provides at least one principle, from a list of pre-determined principles, that assisted in their response;

scoring the response, wherein the scoring is done by at least one of the other players;

tracking the score of all players; and writing the list of predetermined principles before the same is commenced.

10. The method of claim 9, wherein the path has a plurality of categories defined thereon, and the player in-turn is provided with a scenario based on their category on the path.

11. The method of claim 9, wherein the at least one of the other players provides feedback to the player in-turn regarding their response.

* * * * *